US008007321B1

(12) United States Patent
Chi

(10) Patent No.: US 8,007,321 B1
(45) Date of Patent: Aug. 30, 2011

(54) EARPHONE ADAPTER

(75) Inventor: Ming-Chia Chi, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/898,722

(22) Filed: Oct. 6, 2010

(51) Int. Cl.
*H01R 25/00* (2006.01)

(52) U.S. Cl. ..... 439/638; 439/575; 439/527

(58) Field of Classification Search ..... 439/638, 439/527, 528, 531, 574, 575; 248/682, 686, 248/689
See application file for complete search history.

(56) References Cited

U.S. PATENT DOCUMENTS

| | | | | | |
|---|---|---|---|---|---|
| 3,389,367 | A * | 6/1968 | Schwartz | 439/148 |
| 4,802,072 | A * | 1/1989 | Kau | 362/238 |
| 5,236,369 | A * | 8/1993 | Beach et al. | 439/148 |
| 5,320,542 | A * | 6/1994 | Cheng | 439/148 |
| 5,632,552 | A * | 5/1997 | Wang et al. | 362/396 |
| 5,697,698 | A * | 12/1997 | Huang | 362/657 |
| 5,775,802 | A * | 7/1998 | Kuo | 362/396 |
| 5,791,765 | A * | 8/1998 | Lin | 362/249.08 |
| 5,839,820 | A * | 11/1998 | Huang | 362/249.14 |
| 5,908,238 | A * | 6/1999 | Huang | 362/391 |
| 5,915,826 | A * | 6/1999 | Lin | 362/653 |
| 5,921,805 | A * | 7/1999 | Tabata et al. | 439/457 |
| 5,941,628 | A * | 8/1999 | Chang | 362/249.01 |
| 6,019,634 | A * | 2/2000 | Tseng | 439/574 |
| 6,062,711 | A * | 5/2000 | Huang | 362/391 |
| 6,068,229 | A * | 5/2000 | Wang et al. | 248/314 |
| 6,082,874 | A * | 7/2000 | Huang | 362/654 |
| 6,106,138 | A * | 8/2000 | Wei | 362/457 |
| 6,116,951 | A * | 9/2000 | Shu | 439/574 |
| 6,179,647 | B1 * | 1/2001 | Kinderman | 439/470 |
| 6,190,021 | B1 * | 2/2001 | Huang | 362/227 |
| 6,217,193 | B1 * | 4/2001 | Won | 362/249.16 |
| 6,264,502 | B1 * | 7/2001 | Pan | 439/575 |
| 6,267,342 | B1 * | 7/2001 | Huang | 248/316.7 |
| 6,309,087 | B1 * | 10/2001 | Huang | 362/391 |
| 6,315,430 | B1 * | 11/2001 | Huang | 362/249.01 |
| 6,341,881 | B1 * | 1/2002 | Huang | 362/391 |
| 6,428,184 | B1 * | 8/2002 | Huang | 362/657 |
| 6,626,704 | B1 * | 9/2003 | Pikel | 439/638 |
| 6,657,398 | B2 * | 12/2003 | Chang | 315/185 S |
| 6,672,897 | B2 * | 1/2004 | Tseng | 439/505 |
| 7,014,352 | B2 * | 3/2006 | Wu | 362/653 |
| 7,198,506 | B2 * | 4/2007 | Furuya et al. | 439/456 |
| 7,361,058 | B1 * | 4/2008 | Lien et al. | 439/638 |
| 7,500,867 | B1 * | 3/2009 | Doglio et al. | 439/371 |
| 7,618,292 | B1 * | 11/2009 | Lin et al. | 439/640 |
| 7,722,409 | B2 * | 5/2010 | Takamoto et al. | 439/660 |
| 7,798,846 | B2 * | 9/2010 | Yuan | 439/510 |
| 2003/0008564 | A1 * | 1/2003 | Lebron | 439/638 |

* cited by examiner

*Primary Examiner* — Ross Gushi

(57) ABSTRACT

An earphone adapter for being fastened to a cable includes a plug part, a socket part connecting with the plug part and a shell enclosing inner ends of the plug part and the socket part. Several portions of an outer surface of the shell protrude outward to form two first fastening blocks spaced from each other, and a second fastening block located between the two first fastening blocks. A bottom of each first fastening block is concaved inward to form a first fastening groove passing through a side thereof adjacent to the second fastening block. A top of the second fastening block is concaved inward to form a second fastening groove. A substantial middle portion of the cable is placed in the second fastening groove with two ends thereof being clipped in the first fastening grooves along two ends of the second fastening groove, respectively.

3 Claims, 2 Drawing Sheets

EARPHONE ADAPTER

BACKGROUND OF THE INVENTION

1. Field of the Invention

The present invention generally relates to an earphone adapter, and more particularly to an earphone adapter capable of being conveniently carried when unused.

2. The Related Art

With the fast development of electronic technology, more and more portable electronic products have been used in our daily life. The portable electronic products mainly include MP3, MP4, multimedia cell phones and portable radios. Each of the electronic products described above has a better audio processing function to provide marvelous music. The audio output apparatuses of the above-mentioned electronic products are earphones. Specifications of interfaces of the earphones are not fully united. The available interfaces of the earphones have two specifications of 2.5 mm and 3.5 mm. Only plugs and sockets with matchable specifications can be engaged with each other. So, we must provide a transforming apparatus such as an earphone adapter to make the plugs and the sockets with unmatchable specifications be connected with each other. However, volume of the earphone adapter is small, when it's not in use, it's apt to be lost.

SUMMARY OF THE INVENTION

An object of the present invention is to provide an earphone adapter for being fastened to a cable. The earphone adapter includes a plug part, a socket part and a shell. The socket part connects with the plug part. The shell encloses an inner end of the plug part and an inner end of the socket part with outer ends of the plug part and the socket part exposed from two ends thereof. Several portions of an outer surface of the shell protrude outward to form two first fastening blocks spaced from each other, and a second fastening block located between the two first fastening blocks. A bottom of each first fastening block is concaved inward to form a first fastening groove passing through a side thereof adjacent to the second fastening block. A top of the second fastening block is concaved inward to form a second fastening groove passing through two ends thereof. A substantial middle portion of the cable is placed in the second fastening groove with two ends thereof being clipped in the first fastening grooves along two ends of the second fastening groove, respectively.

As described above, the earphone adapter can be fastened to the cable firmly by means of receiving the middle portion of the cable in the second fastening groove and the first fastening grooves. Consequently, when the earphone adapter is unused, it can avoid the earphone adapter being lost, and it's convenient for being carried.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
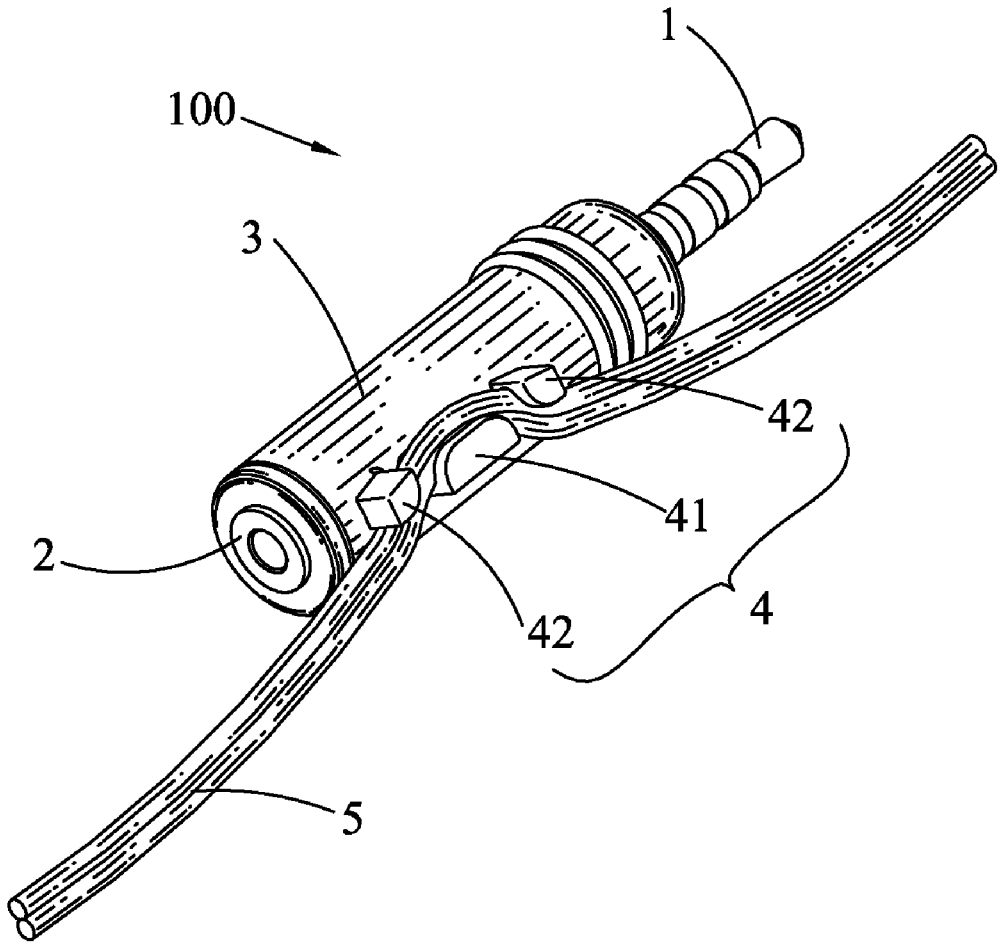
FIG. 1 is a perspective view of an earphone adapter with a cable in accordance with the present invention.

With reference to FIG. 1, an earphone adapter 100 includes a plug part 1, a socket part 2 and a shell 3. The plug part 1 and the socket part 2 are interconnected with each other by a connecting part (not shown). An outer end of the plug part 1 and an outer end of the socket part 2 are exposed from two ends of the shell 3, respectively. The shell 3 encloses an inner end of the plug part 1 and an inner end of the socket part 2 to protect the plug part 1, the socket part 2 and the connecting part (not shown).

Figure 2:
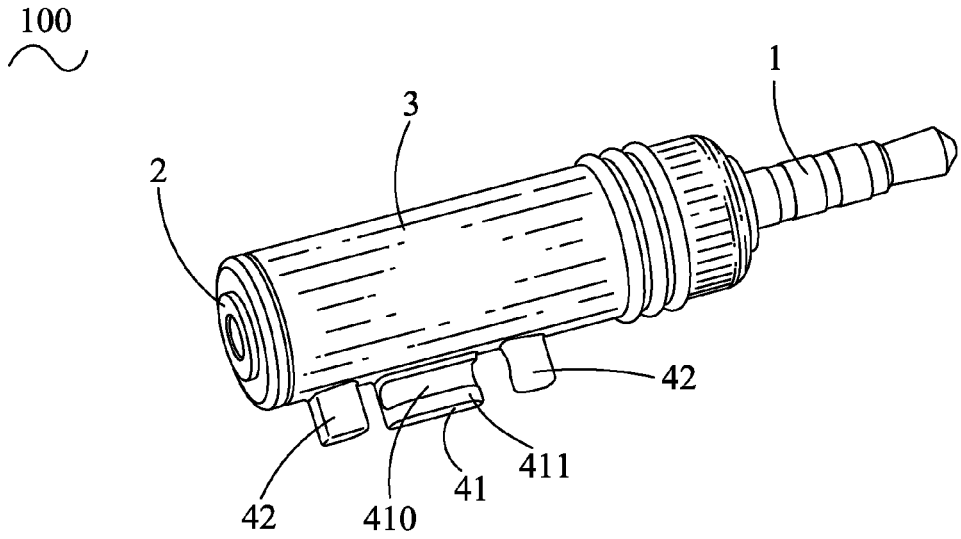
FIG. 2 is a perspective view of the earphone adapter of FIG. 1.
Figure 3:
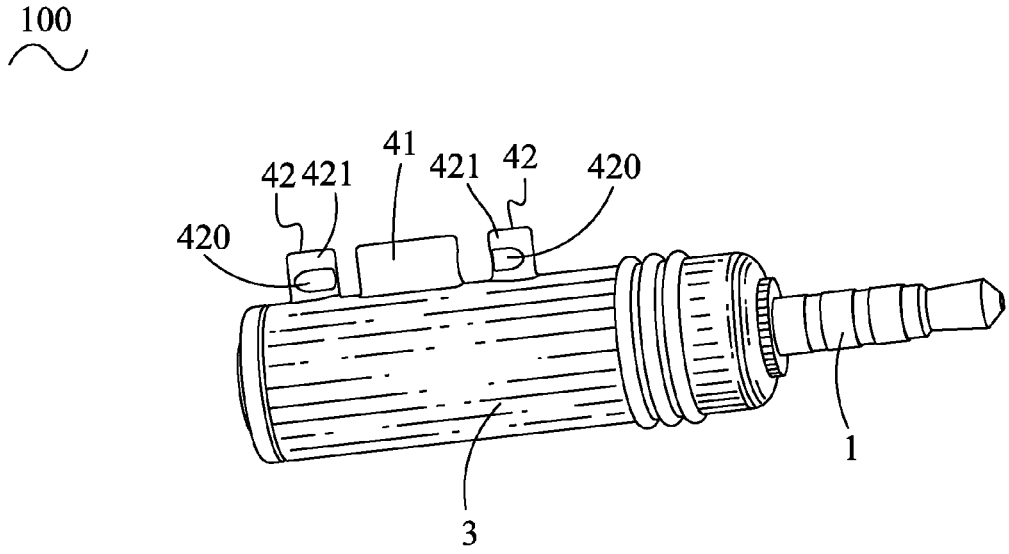
FIG. 3 is another angle perspective view of the earphone adapter of FIG. 1.

Referring to FIGS. 1-3, two portions of an outer surface of the shell 3 protrude outward to form two inclined inverted fan-shaped first fastening blocks 42 spaced from each other. Another portion of the outer surface of the shell 3 protrudes outward to form a semi-elliptical second fastening block 41 located between the two first fastening blocks 42. The two first fastening blocks 42 have two first convex arced surfaces 421 adjacent to two ends of the second fastening block 41, respectively. The second fastening block 41 has a second convex arced surface 411 at a top thereof. Each of the first convex arced surfaces 421 of the first fastening blocks 42 is concaved inward to form a first fastening groove 420. The second convex arced surface 411 of the second fastening block 41 is concaved inward to form a second fastening groove 410 longitudinally passing through the two ends of the second fastening block 41. The first fastening block 42 and the second fastening block 41 together define the fastening structure 4.

Referring to FIGS. 1-3, when the earphone adapter 100 is unused, a substantial middle portion of a cable 5 is placed in the second fastening groove 410, and then two ends of the middle portion of the cable 5 are clipped in the first fastening grooves 420 along two opposite ends of the second fastening groove 410, respectively. So, the cable 5 is fastened to the fastening structure 4.

As described above, the earphone adapter 100 can be fastened to the cable 5 firmly by means of receiving the middle portion of the cable 5 in the second fastening groove 410 and the first fastening grooves 420. Consequently, when the earphone adapter 100 is unused, it can avoid the earphone adapter 100 being lost, and it's convenient for being carried.

What is claimed is:

1. An earphone adapter for being fastened to a cable, comprising:

a plug part;

a socket part connecting with the plug part; and a shell enclosing an inner end of the plug part and an inner end of the socket part with outer ends of the plug part and the socket part exposed from two ends thereof, several portions of an outer surface of the shell protruding outward to form two first fastening blocks spaced from each other, and a second fastening block located between the two first fastening blocks, a bottom of each first fastening block being concaved inward to form a first fastening groove passing through a side thereof adjacent to the second fastening block, a top of the second fastening block being concaved inward to form a second fastening groove passing through two ends thereof, a substantial middle portion of the cable being placed in the second fastening groove with two ends thereof being clipped in the first fastening grooves along two ends of the second fastening groove, respectively.

2. The earphone adapter as claimed in claim 1, wherein the two first fastening blocks are inclined inverted fan-shaped and have two first convex arced surfaces adjacent to the two ends of the second fastening block, the first convex arced surface of each first fastening block is concaved inward to form the first fastening groove.

3. The earphone adapter as claimed in claim 1, wherein the second fastening block is of a semi-elliptical shape and has a second convex arced surface at the top thereof, the second convex arced surface is concaved inward to form the second fastening groove.

* * * * *